US010472859B2

(12) United States Patent
Ku

(10) Patent No.: US 10,472,859 B2
(45) Date of Patent: Nov. 12, 2019

(54) DOOR MOUNT MECHANISM FOR A SMART LOCK SYSTEM

(71) Applicant: CANDY HOUSE INC., Palo Alto, CA (US)

(72) Inventor: Che-Ming Ku, Taichung (TW)

(73) Assignee: CANDY HOUSE INC., Palo Alto, CA (US)

( * ) Notice: Subject to any disclaimer, the term of this patent is extended or adjusted under 35 U.S.C. 154(b) by 8 days.

(21) Appl. No.: 15/117,139

(22) PCT Filed: Oct. 7, 2015

(86) PCT No.: PCT/US2015/054505

§ 371 (c)(1),
(2) Date: Aug. 5, 2016

(87) PCT Pub. No.: WO2016/057677

PCT Pub. Date: Apr. 14, 2016

(65) Prior Publication Data

US 2017/0002585 A1 Jan. 5, 2017

Related U.S. Application Data

(60) Provisional application No. 62/061,204, filed on Oct. 8, 2014, provisional application No. 62/061,212, filed
(Continued)

(51) Int. Cl.
*E05B 47/00* (2006.01)
*E05B 47/02* (2006.01)

(52) U.S. Cl.
CPC ..... *E05B 47/0012* (2013.01); *E05B 47/02* (2013.01); *E05B 2047/0084* (2013.01);
(Continued)

(58) Field of Classification Search
CPC ..... E05B 47/0012; E05B 63/0004; E05B 2047/0091; E05B 2047/002;
(Continued)

(56) References Cited

U.S. PATENT DOCUMENTS 4,557,124 A * 12/1985 Russ ..... H01M 2/1055 70/456 R
5,592,839 A * 1/1997 Hasan ..... A45C 11/327 70/456 R
(Continued)

FOREIGN PATENT DOCUMENTS

CA 2789278 C 10/2010

OTHER PUBLICATIONS

International Search Report, PCT/US15/054505, dated Jan. 5, 2016 (2 pages).

*Primary Examiner* — Lloyd A Gall
(74) *Attorney, Agent, or Firm* — Hamre, Schumann, Mueller & Larson, P.C.

(57) ABSTRACT

A door mount mechanism is to be mounted onto a door for rotating a thumb turn of a door lock. The door mount mechanism includes a casing, a rotatable component and an intermediate coupling. The casing is for abutting against the door, and defines a receiving space that is adapted for receiving the door lock. The rotatable component is coupled rotatably to the casing. The intermediate coupling includes a first coupling segment connected co-rotatably to the rotatable component, and a second coupling segment connected co-rotatably to and linearly movable relative to the first coupling segment and for driving rotation of the thumb turn of the door lock such that the thumb turn is co-rotatable with the rotatable component.

15 Claims, 18 Drawing Sheets

Related U.S. Application Data on Oct. 8, 2014, provisional application No. 62/061,209, filed on Oct. 8, 2014.

(52) U.S. Cl.
CPC ..... *E05B 2047/0091* (2013.01); *E05B 2047/0095* (2013.01)

(58) Field of Classification Search
CPC ..... E05B 2047/0005; E05B 2047/0017; E05B 47/0038; E05B 47/02; E05B 2047/0095; E05B 2047/0084
USPC ..... 70/408, 456 R, 278.1, 278.3, 256, 257, 70/277, 278.7, 279.1, 280–282; 292/141, 292/142, 144
See application file for complete search history.

(56) References Cited

U.S. PATENT DOCUMENTS 5,678,436 A * 10/1997 Alexander ..... E05B 47/0012 70/256
5,704,235 A * 1/1998 Stahle ..... A45C 11/324 206/37.1
5,887,468 A * 3/1999 Hasan ..... A45C 11/321 70/456 R
6,216,502 B1 * 4/2001 Cannella ..... E05B 47/0012 292/142
6,324,879 B1 12/2001 Kennedy
6,591,643 B1 7/2003 Cannella et al.
6,742,369 B1 6/2004 Veillette
7,373,795 B2 5/2008 Kilbourne
8,869,574 B2 * 10/2014 Schmidt-Lackner ..... E05B 17/147 292/244
9,476,232 B1 * 10/2016 Verdecia ..... E05B 19/00
9,624,695 B1 * 4/2017 Cheng ..... E05B 47/0001
2008/0296912 A1 12/2008 Whitner et al.
2009/0084147 A1 4/2009 Mizutani et al.
2014/0260447 A1 * 9/2014 Schmidt-Lackner ..... E05B 47/068 70/262
2017/0002586 A1 * 1/2017 Lee ..... E05B 47/0012

* cited by examiner

DOOR MOUNT MECHANISM FOR A SMART LOCK SYSTEM

CROSS-REFERENCE TO RELATED APPLICATIONS

This application claims priorities of U.S. Provisional Patent Application No. 62/061,212, filed on Oct. 8, 2014, U.S. Provisional Patent Application No. 62/061,204, filed on Oct. 8, 2014, and U.S. Provisional Patent Application No. 62/061,209, filed on Oct. 8, 2014.

FIELD

The disclosure relates to a door mount mechanism, more particularly to a door mount mechanism for a smart lock system.

BACKGROUND

Electronic security systems have been well known for a number of years. In recent years, electronic technology has been used with traditional door locks to provide smart locks. A conventional smart lock generally includes a door mount that is adapted to be fitted onto a door lock, and that is controlled by a control system. A disadvantage of the conventional smart lock is that the installation of the door mount is relatively complicated and time-consuming.

FIG. 1 illustrates a typical mechanical lock device 100. The typical mechanical lock device 100 includes a base plate 102, and a thumb turn 104 connected rotatably to the base plate 102. In use, the mechanical lock device 100 is mounted on a door 200 (see FIG. 2) with the base plate 102 being coupled to the door 200 at a position close to a handle 202. The mechanical lock device 100 has various configurations in terms of the shape of the thumb turn 104, such as being elliptic (see FIG. 1), triangular (see FIG. 2) or round (see FIG. 3), and in terms of the location of the thumb turn 104 on the base plate 102.

Another disadvantage of the conventional smart lock is that the door mount of the conventional smart lock may not be properly and quickly fitted onto the thumb turn 104 of different sizes and at locations of the typical mechanical lock device 100.

SUMMARY

Therefore, the object of the disclosure is to provide a door mount mechanism for a smart lock system that can alleviate at least one of the drawbacks associated with the above-mentioned prior art.

Accordingly, a door mount mechanism of the present disclosure is adapted for use in a smart lock system. The door mount mechanism is adapted to be mounted onto a door for rotating a thumb turn of a door lock which is mounted on the door. The door mount mechanism includes a casing, a rotatable component and an intermediate coupling. The casing has a door-mounting end that is adapted for abutting against the door, and defines a receiving space that is adapted for receiving the door lock, and that has an opening at the door-mounting end and adapted for extension of the door lock therethrough. The rotatable component is coupled rotatably to the casing. The intermediate coupling includes a first coupling segment that is connected co-rotatably to the rotatable component, and a second coupling segment that is connected co-rotatably to and linearly movable relative to the first coupling segment and that is adapted for driving rotation of the thumb turn of the door lock such that the thumb turn is co-rotatable with the rotatable component.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
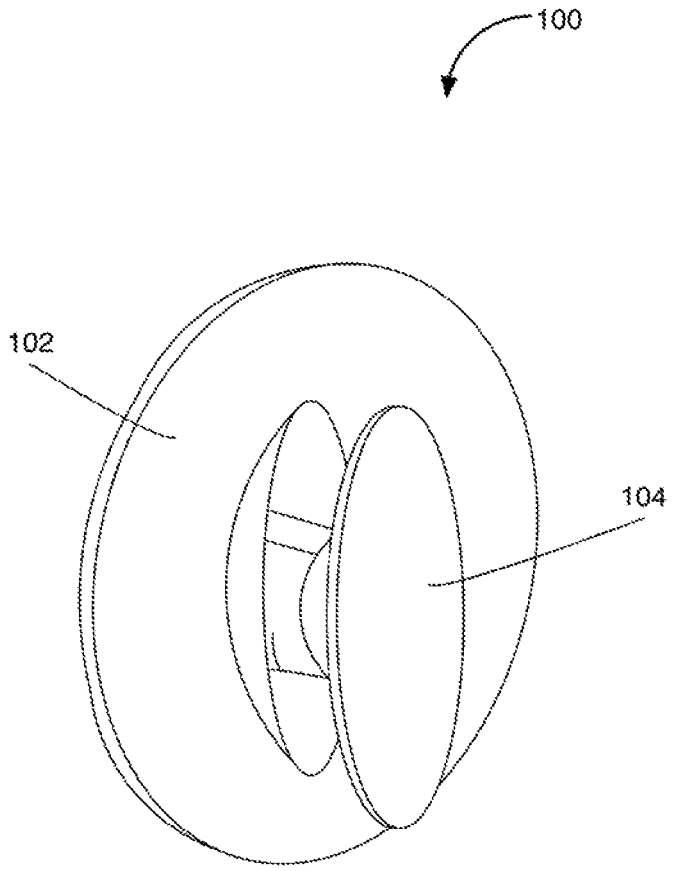
FIG. 1 PRIOR ART
FIG. 1 is a perspective view of a typical mechanical lock device.
Figure 2:
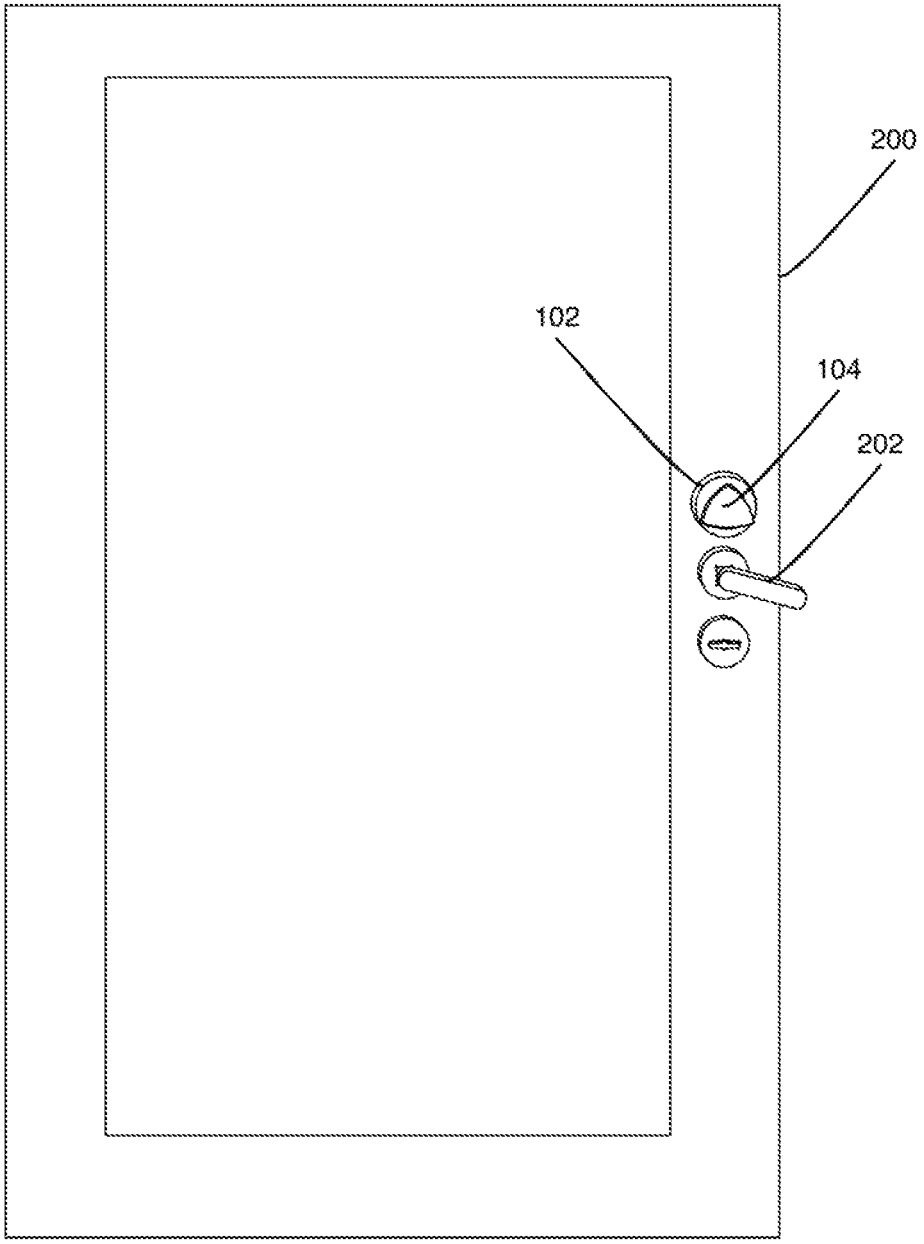
F I G. 2 PRIOR ART
FIG. 2 is another perspective view of a variation of the typical mechanical lock device mounted on a door.
Figure 3:
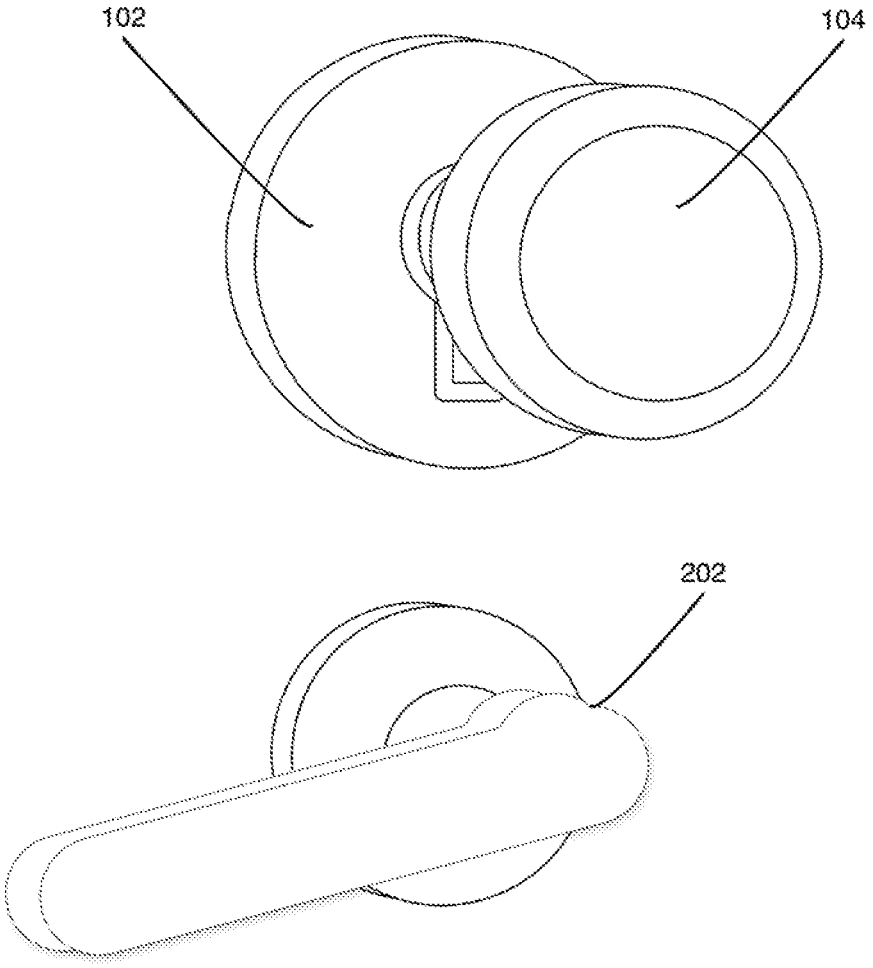
FIG. 3 PRIOR ART
FIG. 3 is a perspective view of another variation of the typical mechanical lock device and a door handle.

Before the present invention is described in greater detail, it should be noted that like elements are denoted by the same reference numerals throughout the disclosure.

As shown in FIGS. 4 to 8, a first embodiment of a door mount mechanism according to the present disclosure is adapted for use in a smart lock system, and is adapted to be mounted onto a door (not shown) for rotating a thumb turn (not shown) of a door lock (not shown). The door lock includes a base plate (not shown) which is mounted on the door and on which the thumb turn is rotatably disposed. The door mount mechanism includes a casing 1, a rotatable component 2, an actuating unit 3 and an intermediate coupling 4.

Figure 7:
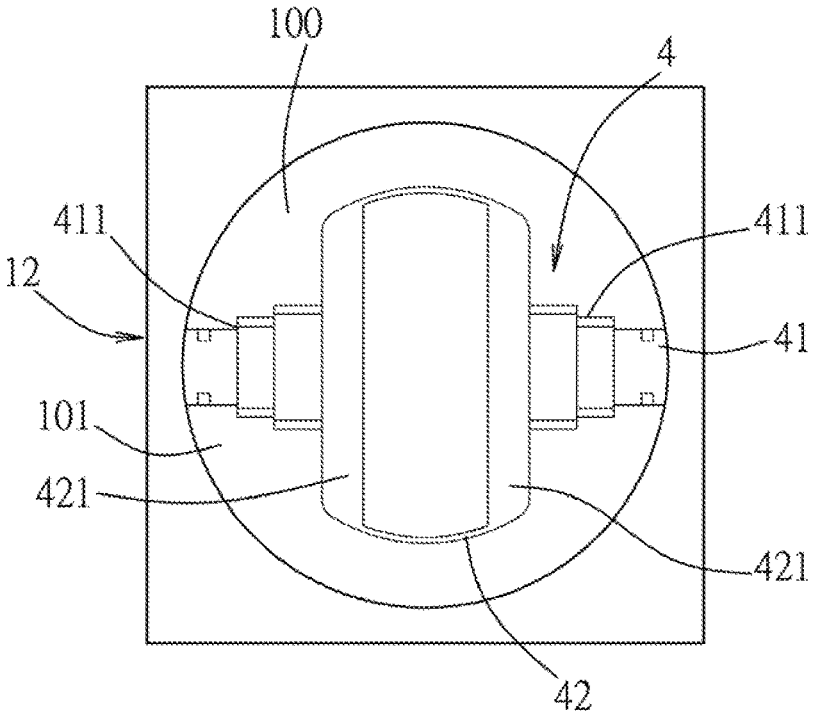
FIG. 7 is a bottom view of an intermediate coupling of the first embodiment.

The casing 1 includes a base wall 11, a surrounding wall 12 extending from a periphery of the base wall 11 and cooperating with the base wall 11 to define a receiving space 100 (see FIG. 7). In this embodiment, the base wall 11 is substantially square. The surrounding wall 12 has a door-mounting end 121, and the receiving space 100 has an opening 101 (see FIG. 7) at the door-mounting end 121. In this embodiment, the base wall 11 is formed with a round hole 111.

The rotatable component 2 is coupled rotatably to the casing 1. The rotatable component 2 has a base portion 21 engaging rotatably the round hole 111 of the casing 1, and a knob portion 22 projecting from the base portion 21 away from the receiving space 100 and being accessible to a user.

The actuating unit 3 includes an actuating module 31 that includes a motor and a solenoid valve, and a gear set 32 that is driven rotatably by the motor of the actuating module 31. The actuating unit 3 is connected to a control circuit (not shown). During operation of the smart lock system, the control circuit receives commands from a user device, such as a mobile phone, and the actuating unit 3 is activated by signals received from the control circuit to operate to drive rotation of the rotatable component 2.

Figure 8:
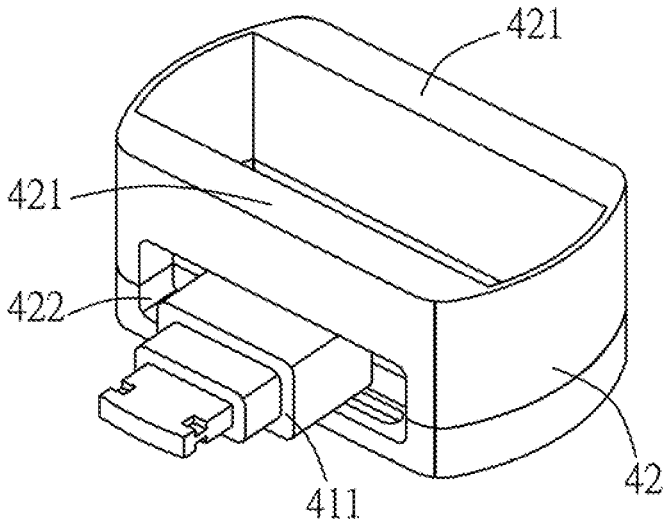
FIG. 8 is a fragmentary perspective view of the intermediate coupling of the first embodiment.
Figure 9:
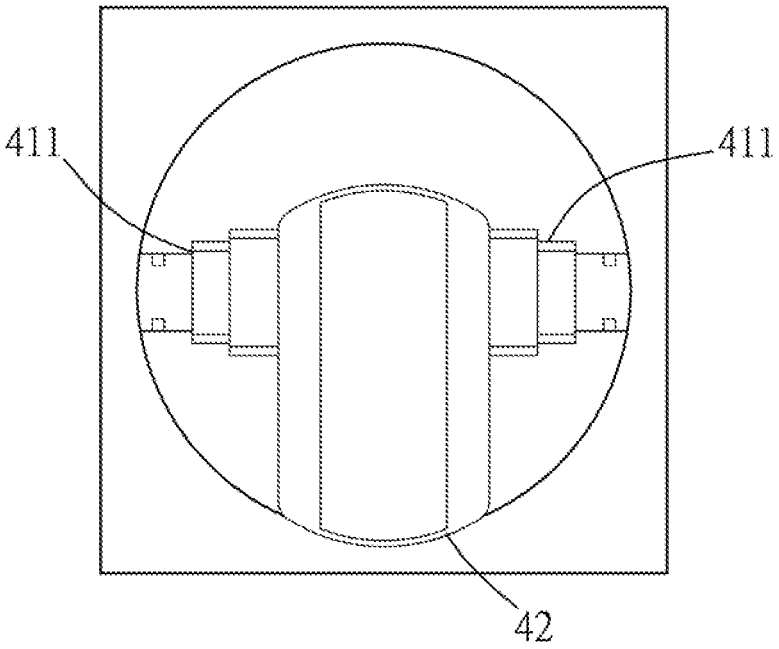
FIG. 9 is a view similar to FIG. 7, but illustrating a second coupling segment being moved relative to a first coupling segment.

The intermediate coupling 4 includes a first coupling segment 41 and a second coupling segment 42. In this embodiment, the second coupling segment 42 is made from an elastic material, is configured as a hollow frame, and has two parallel side frame sections 421 and two parallel elongated slide grooves 422 (only one is shown in FIG. 8) respectively formed in the side frame sections 421 and facing away from each other. The first coupling segment 41 has two subsegments 411. Each of the subsegments 411 is configured as a telescopic structure, and has a first end that is connected fixedly and co-rotatably to the rotatable component 2, and a second end that is opposite to the first end and that engages slidably a respective one of the slide grooves 422. Specifically, the subsegments 411 are collinearly arranged with each other and are perpendicular to the slide grooves 422. As such, a distance between the first and second ends of each of the subsegments 411 is adjustable, and the second coupling segment 42 is connected co-rotatably to and is linearly movable relative to the first coupling segment 41 (see FIGS. 8 and 9).

In use, the casing 1 is mounted onto the door with the door-mounting end 121 of the surrounding wall 12 abutting against the door and surrounding the base plate of the door lock, and with the door lock extending into the receiving space 100 through the opening 101 until the thumb turn of the door lock is surrounded by and inserted into the second coupling segment 42. During the interconnection between the second coupling segment 42 and the thumb turn of the door lock, due to the elasticity of the side frame sections 421 and the length-adjustable, telescopic structure of the subsegments 411 of the first coupling segment 41, the side frame sections 421 are deformable in a first direction in which the subsegments 411 extend. In addition, the second coupling segment 42 is slidable relative to the first coupling segment 41 in a second direction perpendicular to the first direction. Therefore, the intermediate coupling 4 has a relatively great flexibility in terms of fitting onto the thumb turn of different sizes, shapes, or at various relative locations of the base plate. Therefore, when the actuating unit 3 is remotely controlled to actuate rotation of the rotatable component 2, the thumb turn is rotated together with the rotatable component 2. Moreover, with the knob portion 22 being accessible to the user, the rotatable component 2 can also be manually rotated.

Figure 10:
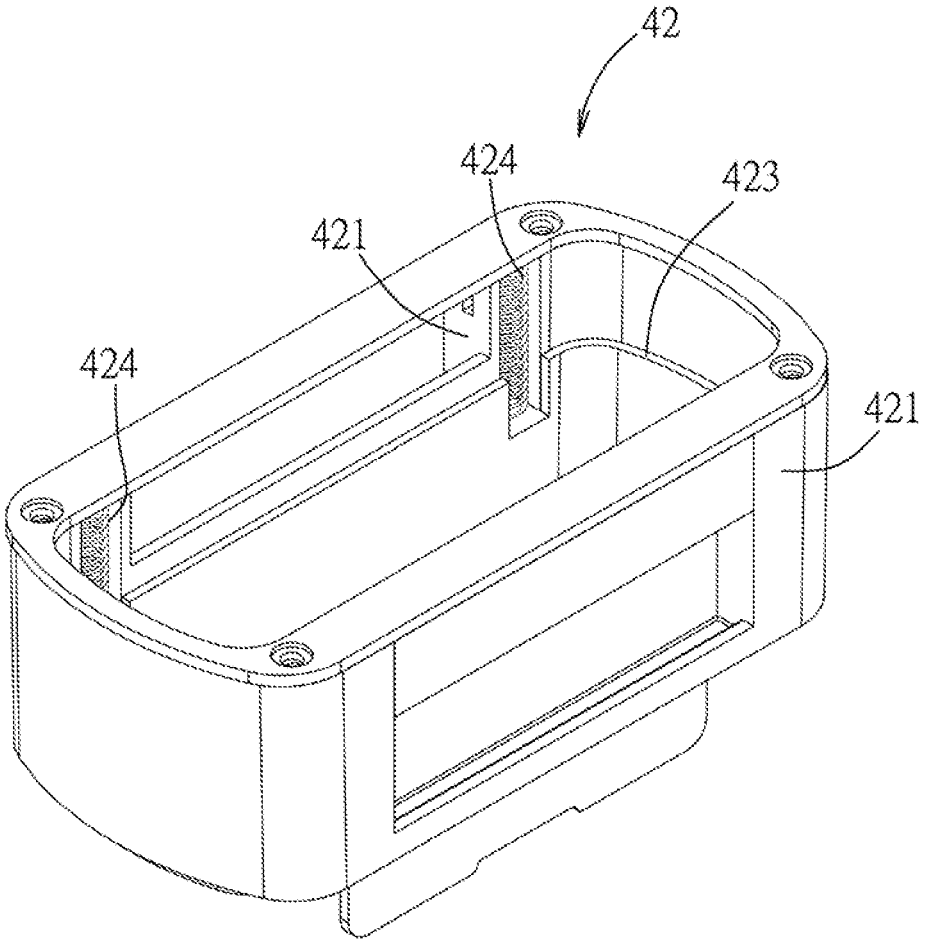
FIG. 10 is an assembled perspective view of a modification of the second coupling segment.
Figure 11:
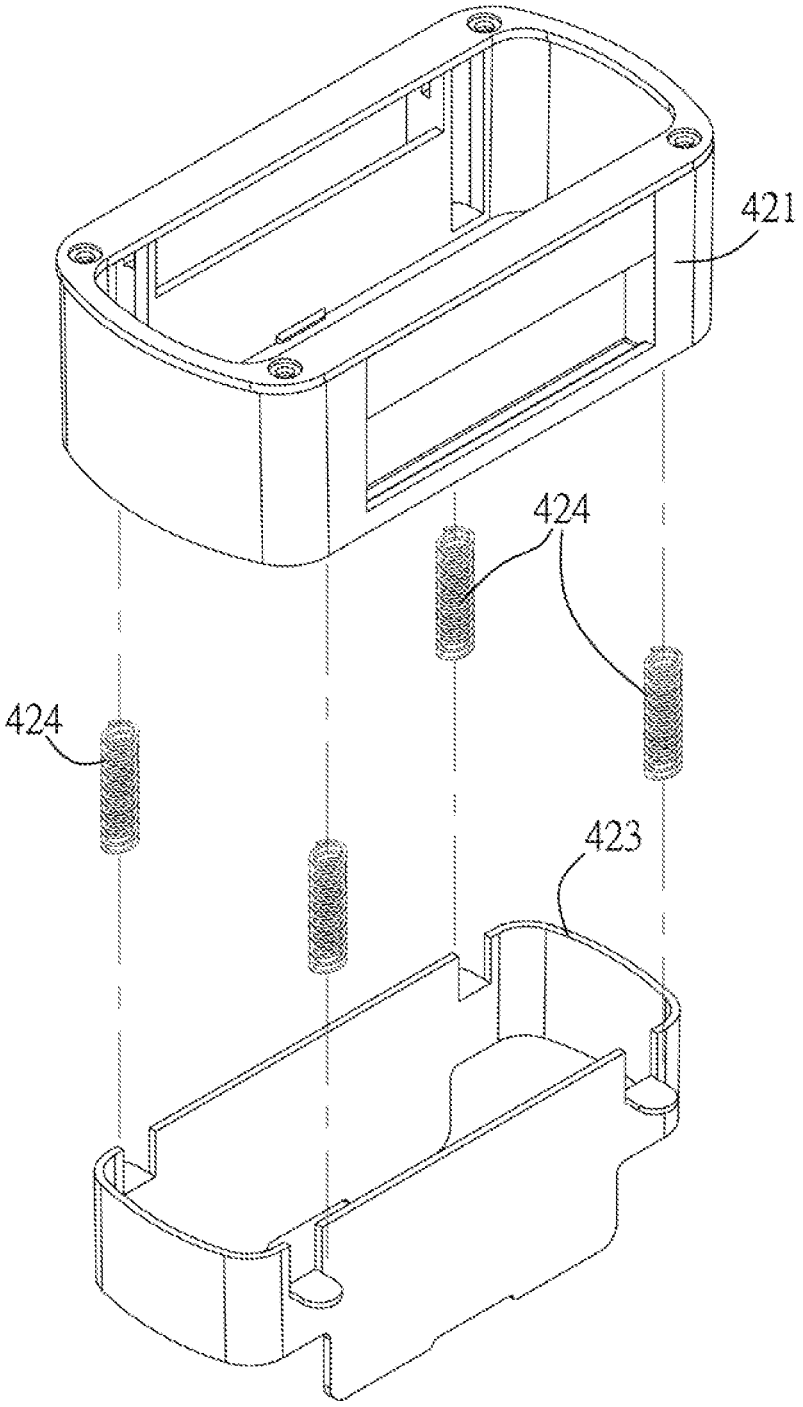
FIG. 11 is an exploded perspective view of the modification of the second coupling segment.

FIGS. 10 and 11 illustrate a modification of the first embodiment, in which the second coupling segment 42 further has an extension section 423 that is coupled telescopically to the side frame sections 421, and a plurality of resilient members 424 that are disposed between the side frame sections 421 and the extension section 423, and that are located at corners of the extension section 423 for biasing the extension section 423 in a direction away from the side frame sections 421. Therefore, the intermediate coupling 4 (see FIG. 7) is capable of firmly holding a relatively large thumb turn with a distal end of the extension section 423 abutting resiliently against a base plate on which the thumb turn is rotatably mounted.

Figure 12:
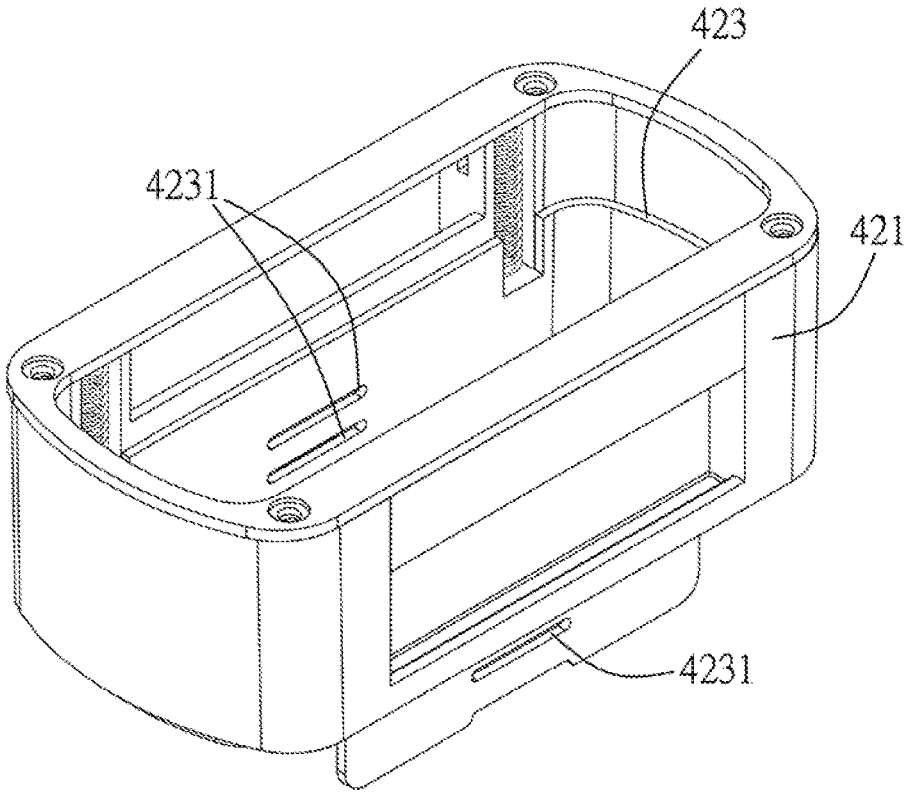
FIG. 12 is an assembled perspective view of another modification of the second coupling segment.
Figure 13:
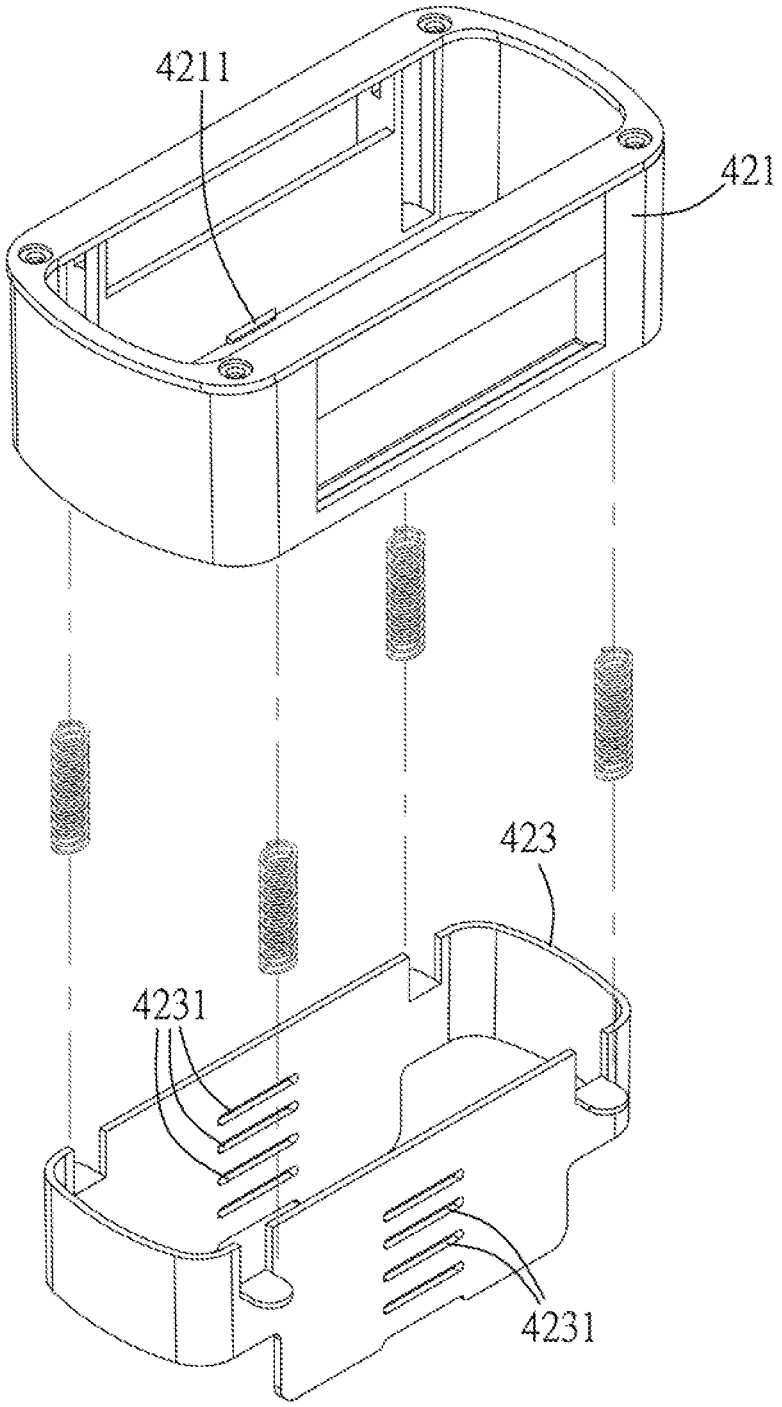
FIG. 13 is an exploded perspective view of the another modification of the second coupling segment.
Figure 14:
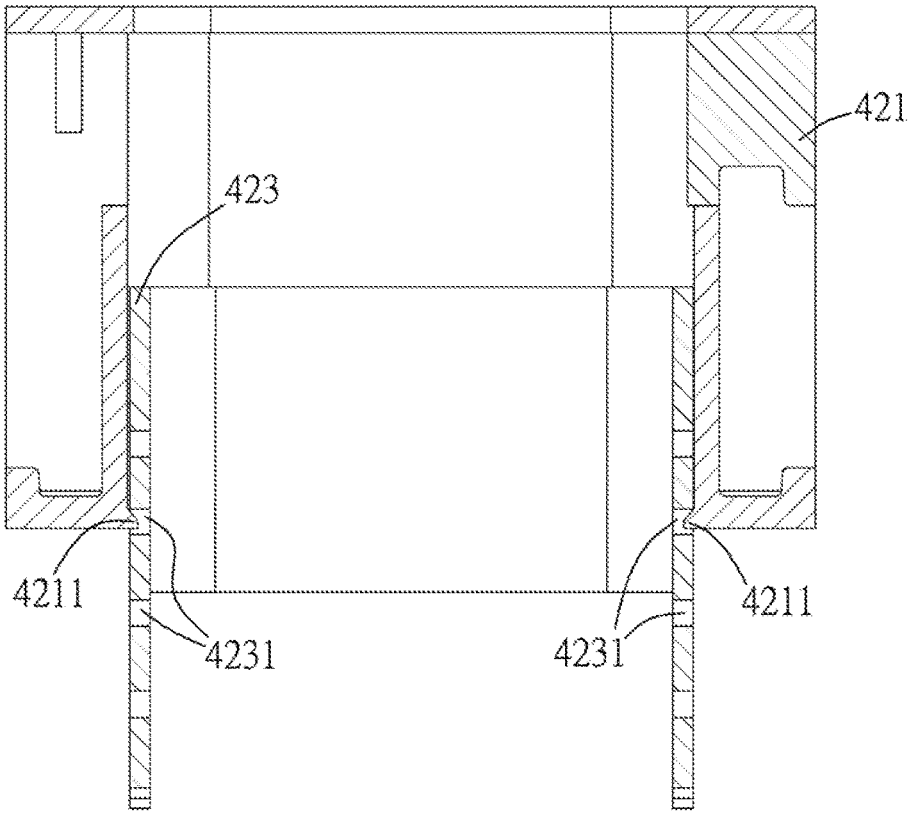
FIG. 14 is a sectional view of the another modification of the second coupling segment.

FIGS. 12 to 14 illustrate another modification of the first embodiment, in which the extension section 423 is formed with a plurality of positioning slots 4231, and the side frame sections 421 are formed with a plurality of positioning protrusions 4211 (only one is visible in FIG. 13). The user can manually move the extension section 423 relative to the side frame sections 421, and engage the positioning protrusions 4211 with corresponding ones of the positioning slots 4231 to position the extension section 423 at a desired position relative to the side frame sections 421.

Figure 15:
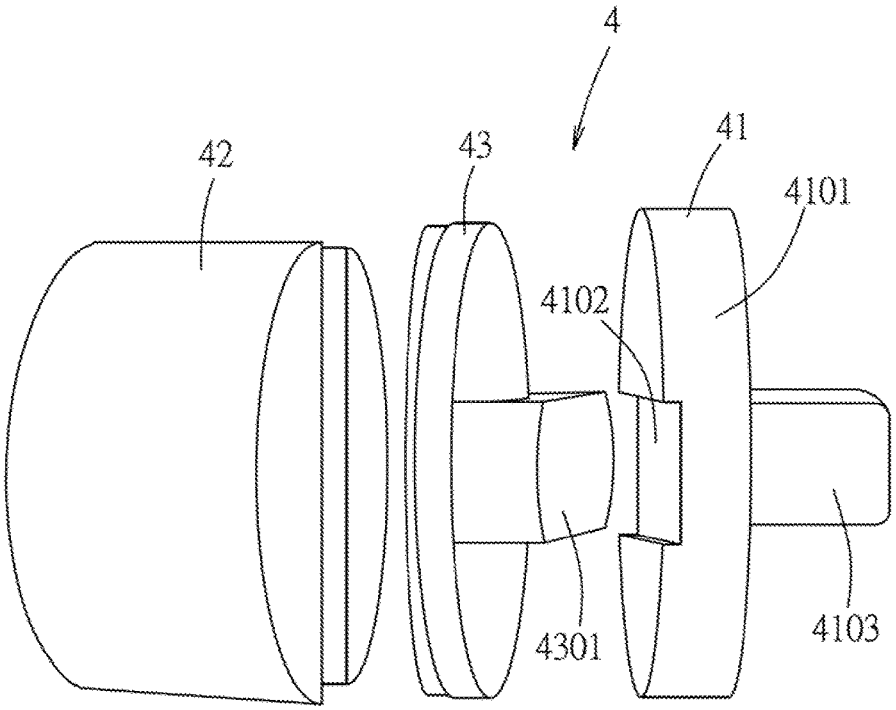
FIG. 15 is an exploded perspective view of the intermediate coupling of a second embodiment of a door mount mechanism according to the disclosure.
Figure 16:
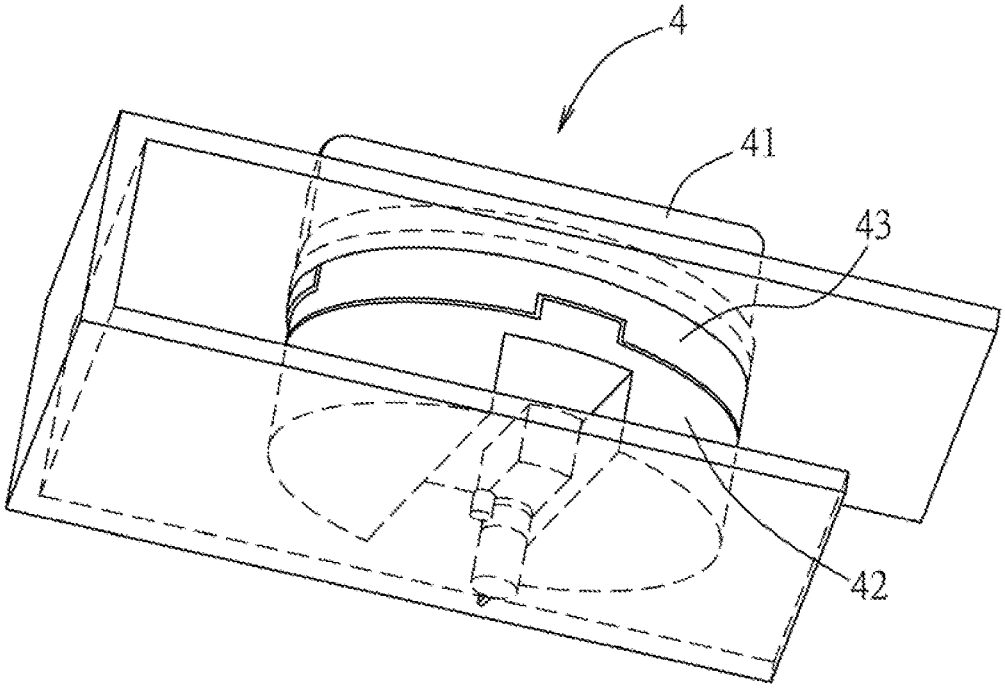
FIG. 16 is an assembled perspective view of the intermediate coupling of the second embodiment.

As shown in FIGS. 15 and 16, the second embodiment of a door mount mechanism according to the present disclosure differs from the first embodiment in the configuration of the intermediate coupling 4.

In this embodiment, the intermediate coupling 4 further includes a third coupling segment 43 interposed between the first and second coupling segments 41, 42. The intermediate coupling 4 is configured as an oldham coupling. Specifically, the first coupling segment 41 has a plate section 4101 that is formed with an elongated groove 4102, and an engaging section 4103 that projects at a side opposite to the elongated groove 4102 to be connected co-rotatably to the rotatable component 2 (see FIG. 4). The third coupling segment 43 has a surface that faces the first coupling segment 41 and an elongated tongue 4301 that is formed on the surface and that fittingly and slidably engages the elongated groove 4102. The second and third coupling segments 42, 43 are coupled together via a similar tongue-and-groove mechanism, but the elongated tongue and groove provided between the second third coupling segments 42, 43 are perpendicular to those provided between the first and third coupling segments 41, 43.

Figure 18:
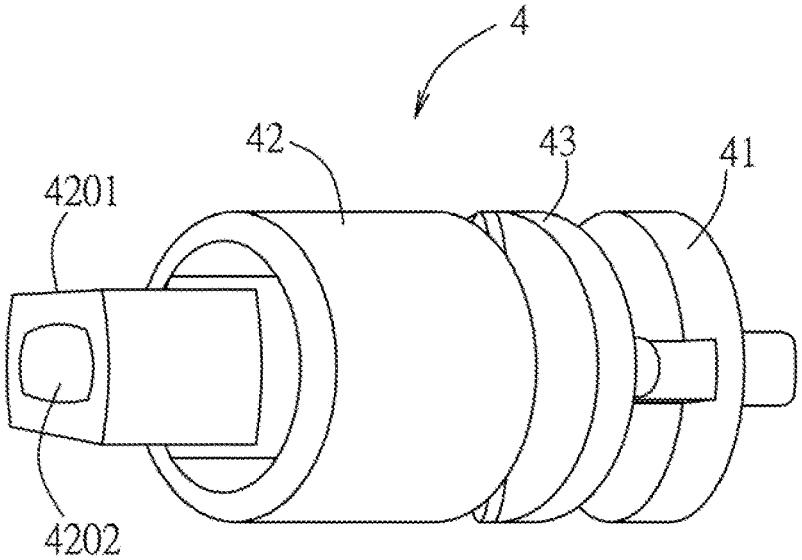
FIG. 18 is an exploded perspective view of a modification of the intermediate coupling of the second embodiment.
Figure 19:
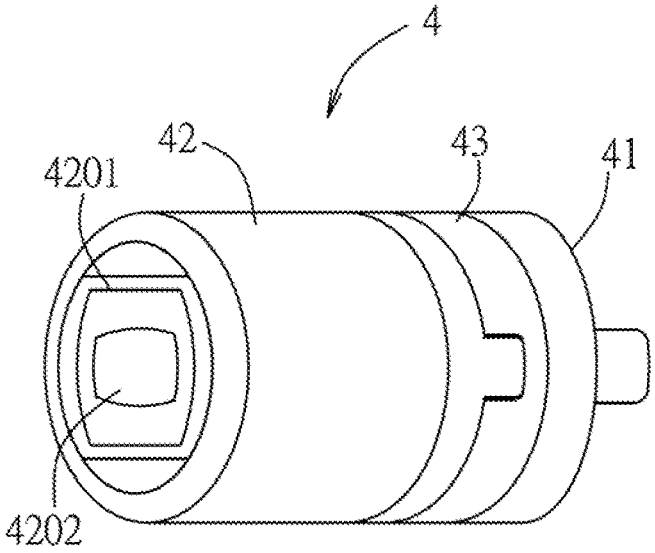
FIG. 19 is an assembled perspective view of the modification of the intermediate coupling of the second embodiment.

It should be noted that, the second coupling segment 42 may be modified into a set of substitutable coupling heads. As shown in FIGS. 18 and 19, each of the coupling heads has a main body 4201 which is formed with a cavity 4202 of a specific shape adapted to be fitted with a thumb turn having the same shape. For example, for a thumb turn shaped substantially rectangular, one of the coupling heads with the cavity 4202 being formed to be substantially rectangular is chosen to fit onto the thumb turn.

Figure 17:
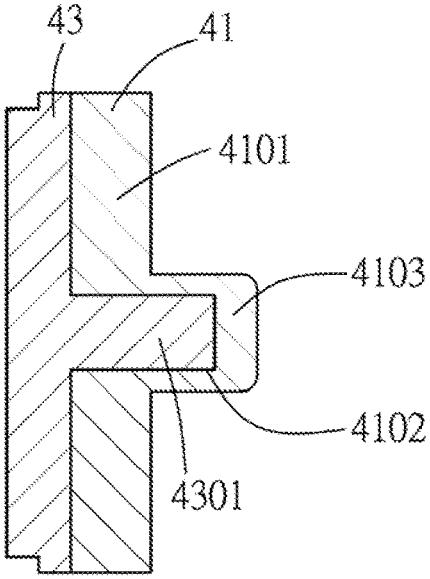
FIG. 17 is a sectional view of a variation of a first coupling segment and a third coupling segment of the intermediate coupling of the second embodiment.

It should be further noted that, while the elongated groove 4102 is formed only in the plate section 4101 in this embodiment, the elongated groove 4102 may be formed through the plate section 4101 into the engaging section 4103 in other embodiments (see FIG. 17), so that the thickness of the plate section 4101 can be decreased, thereby miniaturizing the intermediate coupling 4.

Figure 20:
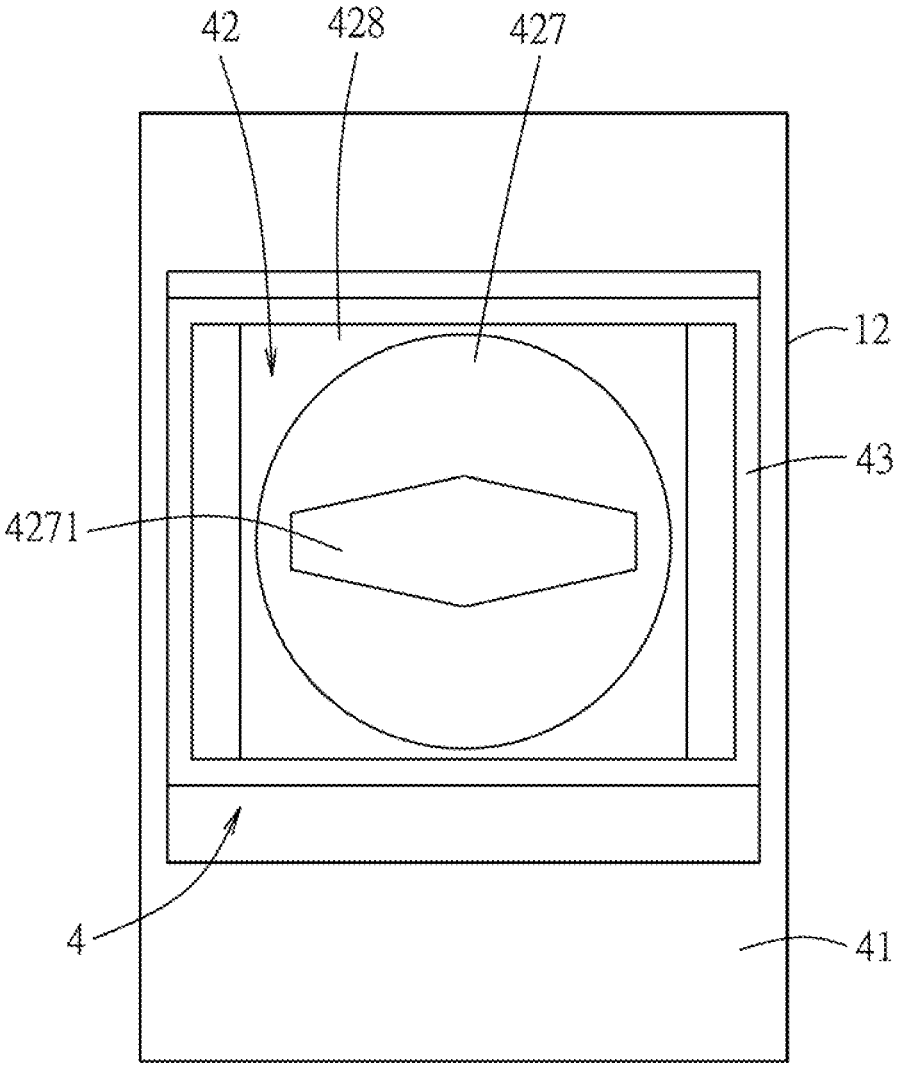
FIG. 20 is a bottom view of the intermediate coupling of a third embodiment of a door mount mechanism according to the disclosure.

As shown in FIG. 20, the third embodiment of a door mount mechanism according to the present disclosure differs from the previous embodiments in the configuration of the intermediate coupling 4.

In this embodiment, the third coupling segment 43 is larger than and surrounds the second coupling segment 42. The second coupling segment 42 has opposite edges coupled slidably and respectively to the third coupling segment 43 via tongue-and-groove mechanisms. The first coupling segment 41 is larger than and surrounds the third coupling segment 43, and the third coupling segment 43 has opposite edges coupled slidably and respectively to the first coupling segment 41 via tongue-and-groove mechanisms (which are not co-rotatable with the first coupling segment 41), such that the second coupling segment 42 is movable relative to the first coupling segment 41 in a first direction, and is movable relative to the first coupling segment 41 via the third coupling segment 43 in a second direction perpendicular to the first direction. In addition, the second coupling segment 42 has a rigid outer part 428 coupled slidably to the third coupling segment 43, and a rotatable inner part 427 surrounded by the rigid outer part 428, formed with a cavity 4271 that is adapted to receive the thumb turn of the door lock, and made from an elastic material so that the second coupling segment 42 can fit on thumb turns of different shapes and sizes.

Figure 21:
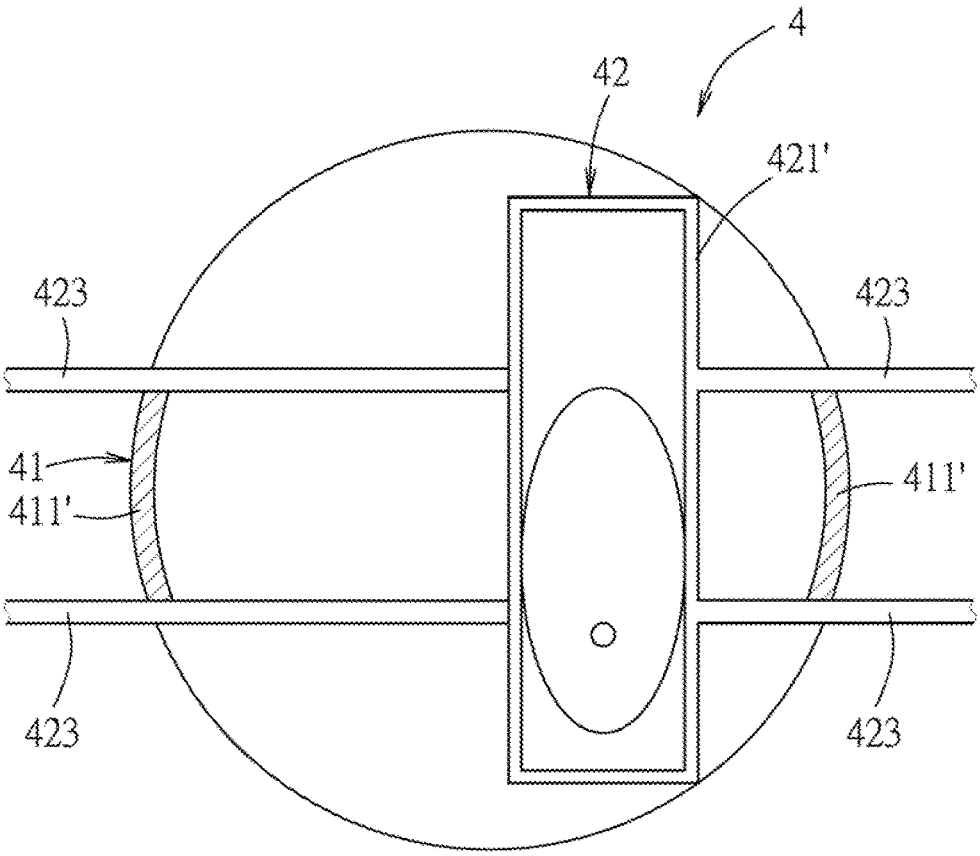
FIG. 21 a bottom view of the intermediate coupling of a fourth embodiment of a door mount mechanism according to the disclosure.

Referring to FIG. 21, the fourth embodiment of a door mount mechanism according to the present disclosure differs from the previous embodiments in the configuration of the intermediate coupling 4.

Figure 4:
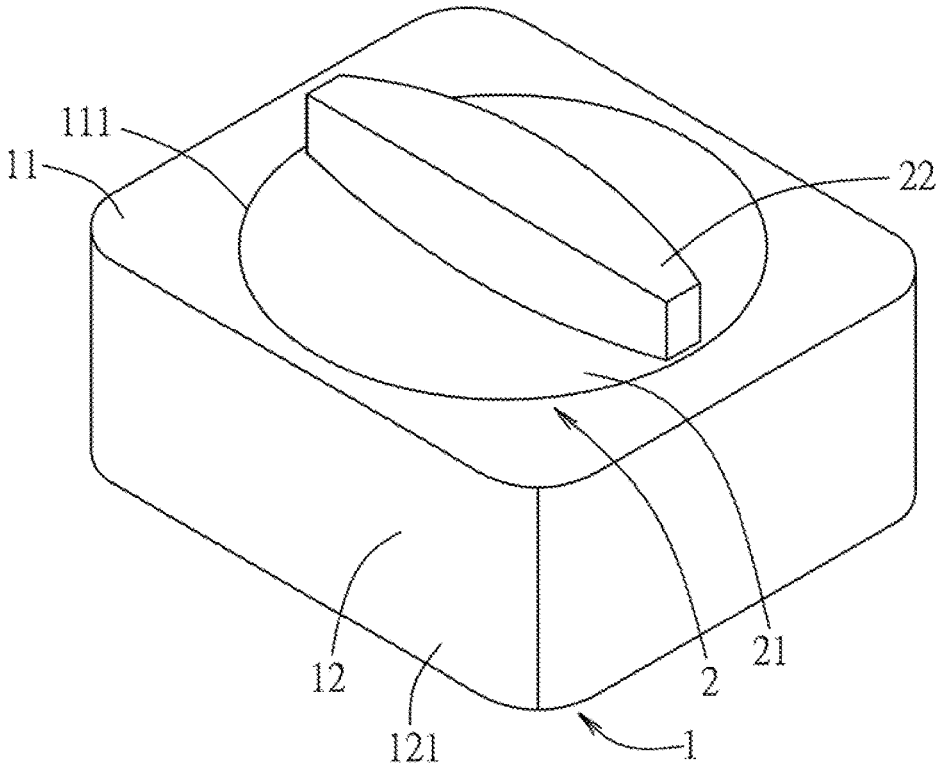
FIG. 4 is a perspective view of a first embodiment of a door mount mechanism according to the disclosure.
Figure 5:
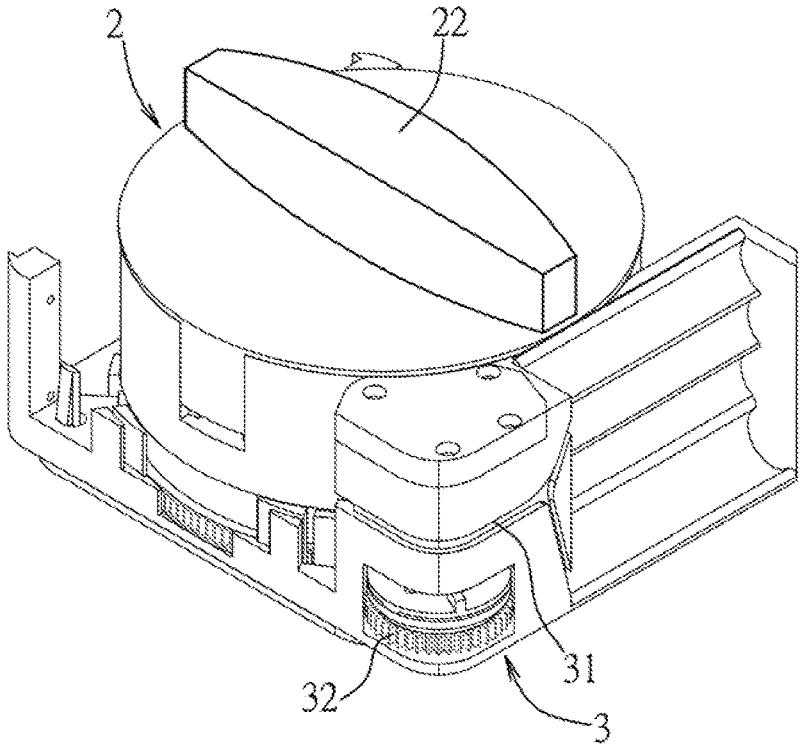
FIG. 5 is a perspective view of a rotatable component and an actuating unit of the first embodiment.
Figure 6:
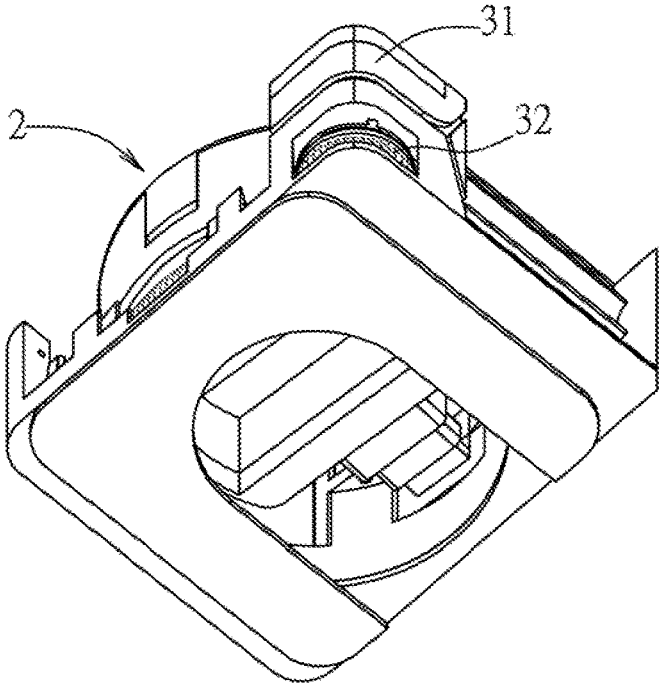
FIG. 6 is another perspective view of the rotatable component and the actuating unit of the first embodiment.

In this embodiment, the first coupling segment 41 has two subsegments 411' connected to a periphery of the rotatable component 2 (see FIG. 4). Each of the subsegments 411' has opposite first and second ends. The first ends of the subsegments 411' are aligned with each other in a first direction, and the second ends of the subsegments 411' are aligned with each other in the first direction. The second coupling segment 42 has a main subsegment 421' adapted for surrounding the thumb turn of the door lock, and four coupling subsegments 423. Two of the coupling subsegments 423 are connected to an end of the main subsegment 421' and are connected slidably and respectively to the first and second ends of one of the subsegments 411'. The other two of the coupling segments 423 are connected to an opposite end of the main subsegment 421' and are connected slidably and respectively to the first and second ends of the other one of the subsegments 411'. As such, the second coupling segment 42 is movable relative to the first coupling segment 41 in the first direction. Moreover, the main subsegment 421' has a width in a second direction perpendicular to the first direction and adapted to be larger than that of the thumb turn. As such, when the thumb turn is eccentric relative to a center of the base plate of the door lock, the main subsegment 421' would be allowed to be movable relative to the thumb turn in the second direction to thereby properly dri ye rotation of the thumb turn.

Figure 22:
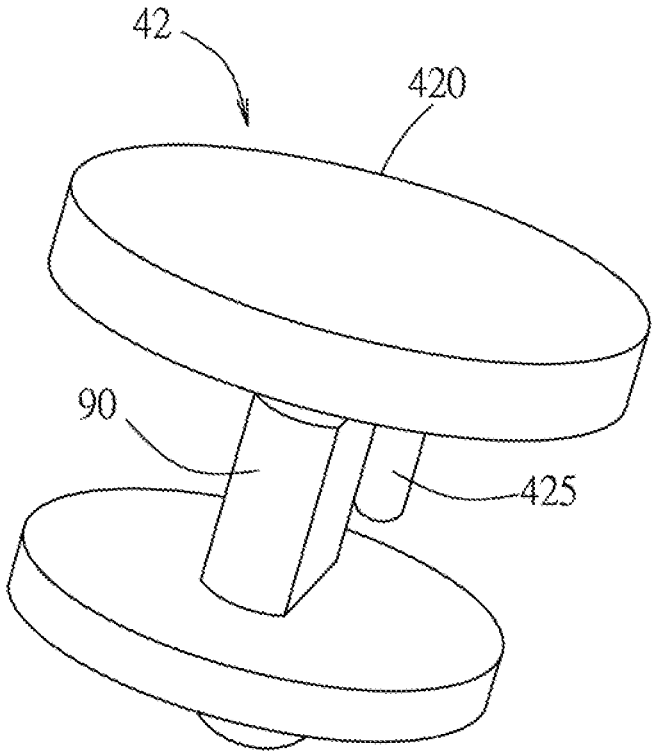
FIG. 22 is a schematic, fragmentary exploded perspective view illustrating a variation of the second coupling segment.

It should be noted that, referring to FIG. 22, the second coupling segment 42 may be configured to have a base board 420 and a driving bar 425 projecting co-rotatably from the base board 420 and eccentrically disposed on the base board 420. The second coupling segment 42 is adapted to push the thumb turn 90 of the door lock to rotate using the driving bar 425 and there is no need for any part of the second coupling segment 42 to be elastic and deformable.

It should be further noted that, the door mount mechanism according to the present disclosure may also be used for rotating a knob of a switch mechanism, such as a switch knob of a washing machine, an oven, and so on.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A door mount mechanism for a smart lock system, said door mount mechanism being adapted to be mounted onto a door for rotating a thumb turn of a door lock which is mounted on the door, said door mount mechanism comprising:

a casing having a door-mounting end that is adapted for abutting against the door, and defining a receiving space that is adapted for receiving the door lock, and that has an opening at said door-mounting end and adapted for extension of the door lock therethrough;

a rotatable component coupled rotatably to said casing; and an intermediate coupling including a first coupling segment that is connected co-rotatably to said rotatable component, and a second coupling segment that is connected co-rotatably to said first coupling segment, that is linearly movable relative to said first coupling segment in a first direction perpendicular to an axis about which the thumb turn rotates and a second direction perpendicular to the axis and perpendicular to the first direction, and that is adapted for driving rotation of the thumb turn of the door lock such that the thumb turn is co-rotatable with said rotatable component.

2. The door mount mechanism as claimed in claim 1, wherein said second coupling segment of said intermediate coupling is made from an elastic material.

3. The door mount mechanism as claimed in claim 1, wherein:

said second coupling segment of said intermediate coupling is configured as a hollow frame that is adapted for surrounding the thumb turn of the door lock, and that has two parallel side frame sections and two parallel slide grooves respectively formed in said side frame sections; and said first coupling segment of said intermediate coupling has two subsegments, each having a first end that is connected co-rotatably to said rotatable component, and a second end that is opposite to said first end and that engages slidably a respective one of said slide grooves.

4. The door mount mechanism as claimed in claim 3, wherein:

said side frame sections of said second coupling segment are made from an elastic material; and each of said subsegments of said first coupling segment is configured as a telescopic structure, such that a distance between said first and second ends is adjustable.

5. The door mount mechanism as claimed in claim 3, wherein said second coupling segment further has an extension section that is coupled telescopically to said side frame sections, and a plurality of resilient members that are disposed between said side frame sections and said extension section for biasing said extension section away from said side frame sections.

6. The door mount mechanism as claimed in claim 3, wherein said second coupling segment further has an extension section that is coupled telescopically to said side frame sections, said extension section being formed with a plurality of positioning slots, said side frame sections being formed with a plurality of positioning protrusions for engaging corresponding ones of said positioning slots to position said extension section at a desired position relative to said side frame sections.

7. The door mount mechanism as claimed in claim 1, wherein said first and second coupling segments of said intermediate coupling are provided with a tongue-and-groove mechanism so that said second coupling segment is linearly movable relative to said first coupling segment.

8. The door mount mechanism as claimed in claim 7, wherein:

said intermediate coupling further includes a third coupling segment that is interposed between said first and second coupling segments;

said third coupling segment is linearly movable relative to said first coupling segment in the first direction; and said second coupling segment is linearly movable relative to said first coupling segment in the second direction.

9. The door mount mechanism as claimed in claim 8, wherein:

said first coupling segment has a plate section formed with an elongated groove, and an engaging section projecting at a side opposite of said elongated groove and connected co-rotatably to said rotatable component; and said third coupling segment has a surface facing said first coupling segment, and an elongated tongue formed on said surface and fittingly and slidably engaging said elongated groove.

10. The door mount mechanism as claimed in claim 9, wherein said elongated groove of said first coupling segment is formed through said plate section into said engaging section.

11. The door mount mechanism as claimed in claim 1, wherein said rotatable component has a base portion connected to said first coupling segment of said intermediate coupling, and a knob portion projecting from said base portion away from said first coupling segment of said intermediate coupling.

12. The door mount mechanism as claimed in claim 1, wherein said second coupling segment of said intermediate coupling has a base board connected co-rotatably to said rotatable component, and a driving bar projecting co-rotatably from said base board for pushing the thumb turn of the door lock to rotate.

13. The door mount mechanism as claimed in claim 1, wherein said second coupling segment includes a set of substitutable coupling heads, each of said coupling heads having a main body that is formed with a cavity of a specific shape and adapted to be fitted with the thumb turn having the same shape.

14. A door mount mechanism for a smart lock system, said door mount mechanism being adapted to be mounted onto a door for rotating a thumb turn of a door lock which is mounted on the door, said door mount mechanism comprising:

a casing having a door-mounting end that is adapted for abutting against the door, and defining a receiving space that is adapted for receiving the door lock, and that has an opening at said door-mounting end and adapted for extension of the door lock therethrough;

a rotatable component coupled rotatably to said casing; and an intermediate coupling including a first coupling segment that is connected co-rotatably to said rotatable component, and a second coupling segment that is connected co-rotatably to said first coupling segment, that is linearly movable relative to said first coupling segment in directions perpendicular to an axis about which the thumb turn rotates, and that is adapted for driving rotation of the thumb turn of the door lock such that the thumb turn is co-rotatable with said rotatable component, wherein said first coupling segment of said intermediate coupling has two subsegments connected to a periphery of said rotatable component, each of said subsegments having opposite first and second ends, said first ends of said subsegments being aligned with each other in a first direction, said second ends of said subsegments being aligned with each other in the first direction; and said second coupling segment of said intermediate coupling has a main subsegment adapted for surrounding the thumb turn of the door lock, and four coupling subsegments, two of said coupling subsegments being connected to an end of said main subsegment and connected slidably and respectively to said first and second ends of one of said subsegments of said first coupling segment, the other two of said coupling subsegments being connected to an opposite end of said main subsegment and connected slidably and respectively to said first and second ends of the other one of said subsegments of said first coupling segment, said main subsegment having a width in a second direction perpendicular to the first direction and adapted to be larger than that of the thumb turn.

15. A smart lock system comprising:

a control circuit for receiving commands from a user device; and a mount mechanism adapted to be mounted onto a subject for rotating a knob of a switch mechanism which is mounted on the subject, and including:

a casing that has a mounting end adapted for abutting against the subject, and that defines a receiving space adapted for receiving the switch mechanism, and having an opening at said mounting end that is adapted for extension of the switch mechanism therethrough, a rotatable component that is coupled rotatably to said casing, an intermediate coupling that includes a first coupling segment connected co-rotatably to said rotatable component, and a second coupling segment connected co-rotatably to said first coupling segment, being linearly movable relative to said first coupling segment in a first direction perpendicular to an axis about which the knob rotates and a second direction perpendicular to the axis and perpendicular to the first direction, and adapted for driving rotation of the knob of the switch mechanism such that the knob is co-rotatable with said rotatable component, and an actuating unit that is connected to said control circuit, said actuating unit being activated by signals that are received from said control circuit, and being adapted for rotating the knob via said intermediate coupling.

* * * * *